United States Patent [19]

Strout

[11] Patent Number: 4,825,790

[45] Date of Patent: May 2, 1989

[54] SAILING CRAFT

[76] Inventor: Theodore M. Strout, 3 Laurel Rd., Ellington, Conn. 06029

[21] Appl. No.: 146,205

[22] Filed: Jan. 20, 1988

[51] Int. Cl.[4] ..... B63B 7/08

[52] U.S. Cl. ..... 114/39.1; 114/162; 114/345; 114/354

[58] Field of Search ..... 114/345, 346, 354, 140, 114/149, 162, 165, 167, 153, 168

[56] References Cited

U.S. PATENT DOCUMENTS

| | | | |
|---|---|---|---|
| 2,531,549 | 11/1950 | Boyd | 114/345 |
| 3,390,656 | 7/1968 | Flowers | 114/39.1 |
| 3,601,076 | 8/1971 | Meeks | 114/39.1 |
| 3,694,835 | 10/1972 | Casey et al. | 114/345 |
| 3,986,473 | 10/1976 | Truzzi | 114/39.1 |
| 4,408,772 | 10/1983 | Höllwarth | 114/354 |

FOREIGN PATENT DOCUMENTS

| | | | |
|---|---|---|---|
| 1808211 | 7/1970 | Fed. Rep. of Germany | 114/39.1 |
| 726191 | 5/1932 | France | 114/345 |

*Primary Examiner*—Sherman D. Basinger
*Assistant Examiner*—Edwin L. Swinehart
*Attorney, Agent, or Firm*—McCormick, Paulding & Huber

[57] ABSTRACT

A sailing craft having components that can be readily assembled or disassembled for use includes a conventional mast and sail received in a forward end portion of a U-shaped frame. This frame forward end portion also releasably supports a forward end of the keel. A horizontally extending portion of the frame carries an inflatable inner tube, and the aft end of the frame releasably supports a post provided for at the aft end of the keel. A rudder is pivotably mounted to the aft end of the keel and can be controlled by a cross bar assembly provided at the forward end of the frame and operable by the users feet. The aft end of the frame also defines a backrest and the user can manipulate the craft with one hand on the main sheet and one or both feet on the cross bar leaving his other hand free for other recreational activities.

4 Claims, 3 Drawing Sheets

SAILING CRAFT

BACKGROUND OF THE INVENTION

This invention relates generally to sailing craft of the type including separable buoyancy means in the form of an inflatable device or light weight expanded foam cockpit defining means.

Typical prior art sailing rigs for inflatable craft are shown in the following prior art Pats. Nos. 4,624,208, 4,082,049 and 2,531,549. These prior art sailing craft all entail the use of sailing rigs incorporated into existing inflatable craft. The present invention provides a unique support frame for the mast structure and the keel structure, which frame also supports a conventional inflatable tire or the like to provide a readily assembled easily transportable sailing craft.

One object of the present invention is to provide a small sailing craft that can be sailed with one hand, that is a sailing craft which avoids the necessity for a hand held tiller, or other steering device.

SUMMARY OF THE INVENTION

In its presently preferred form the present invention comprises a frame with a forward end portion and a generally horizontally extending support portion for the inflatable cockpit defining means. The forward end portion defines a suitable receptacle for receiving the mast and sail structure. A keel is provided below the frame and includes upwardly extending portions that are received in downwardly open receptacles provided for them in the frame. Cross bar means is pivotably mounted in the frame forward end portion for movement about a vertical axis parallel to that defined by the mast itself. The cross bar can be manipulated by the occupant's feet to achieve corresponding movement of a rudder provided for movement on an axis parallel the mast. The cross bar means is coupled to the rudder for achieving such movement.

DETAILED DESCRIPTION OF FIGS. 1–8

Figures 1, 2, 3, 4:
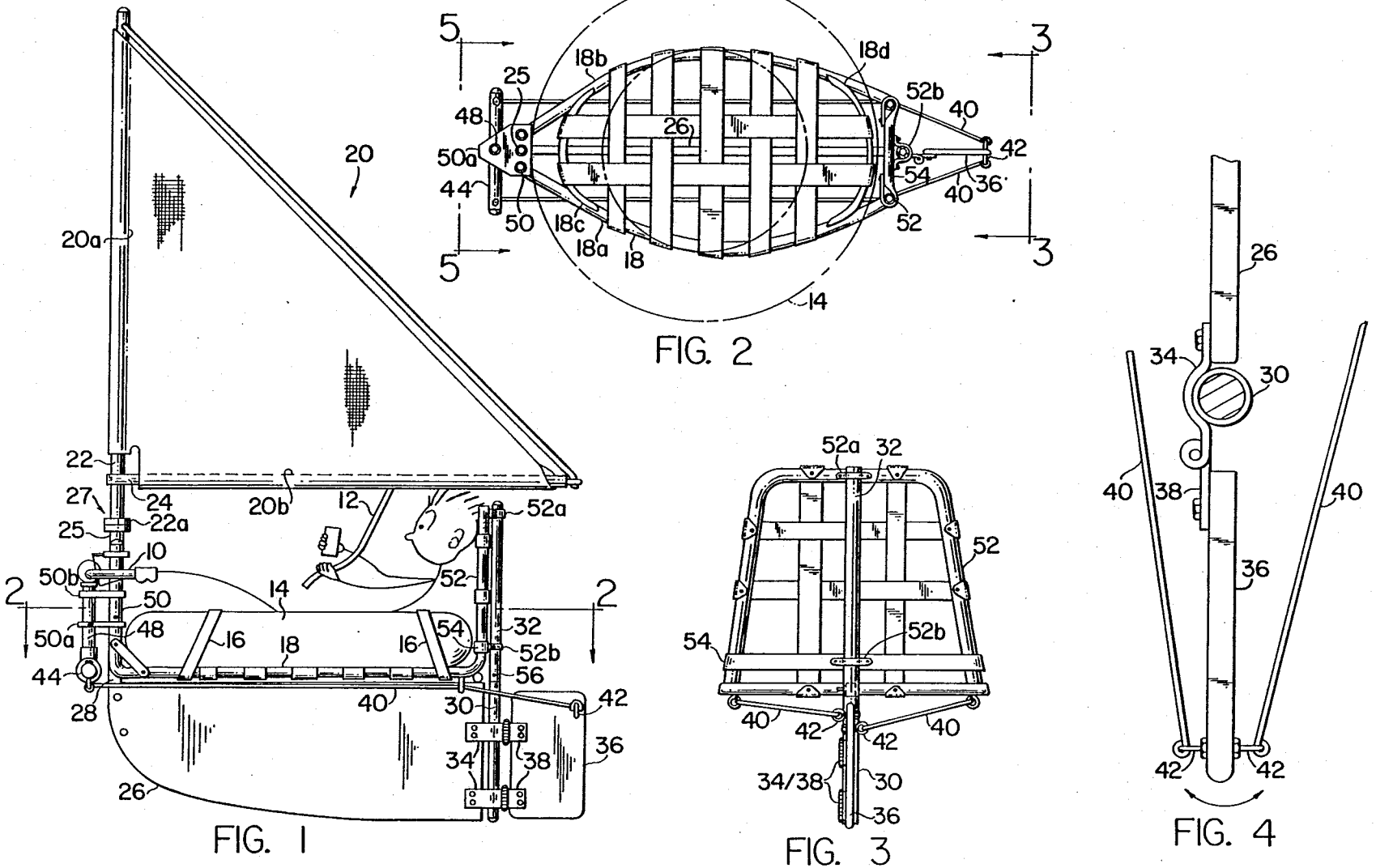
FIG. 1 is a side elevational view illustrating a sailing craft constructed in accordance with one version the present invention.
FIG. 2 is a sectional view taken on the line 2—2 of FIG. 1 showing the U-shaped frame and rudder of the FIG. 1 version and showing the buoyant inflatable means in broken lines only.
FIG. 3 is a rear elevational view being taken generally on the line 3–3 of FIG. 2.
FIG. 4 is a detailed view of the aft end portion of the keel together with the pivotably mounted rudder and associated cable means for its operation.

FIG. 1 shows a presently preferred embodiment of the present invention with all components in assembled relationship to accommodate a sailor in a semi-reclined position with his feet provided on a steering cross bar 10 leaving one hand free to grasp his favorite beverage while the other hand manipulates the main sheet 12.

Buoyant cockpit defining means is provided in the form of a conventional truck tire inner tube 14 and the inner tube 14 is secured in place by straps 16, 16 that serve to secure the buoyant inner tube 14 on a horizontally extending support portion or platform 18 of a U-shaped frame to be described.

The sailing craft further includes a generally conventional mast and sail structure indicated generally at 20. The sail is preferably of triangular configuration and includes mutually perpendicular sleeve defining portions 20a and 20b for receiving the mast 22 and boom 24 respectively. The main sheet or line 12 is connected to the boom in conventional fashion and the forward end of the boom 24 is pivotably connected to the mast 22 in accordance with conventional practice.

Figures 5, 6, 7, 8, 11:
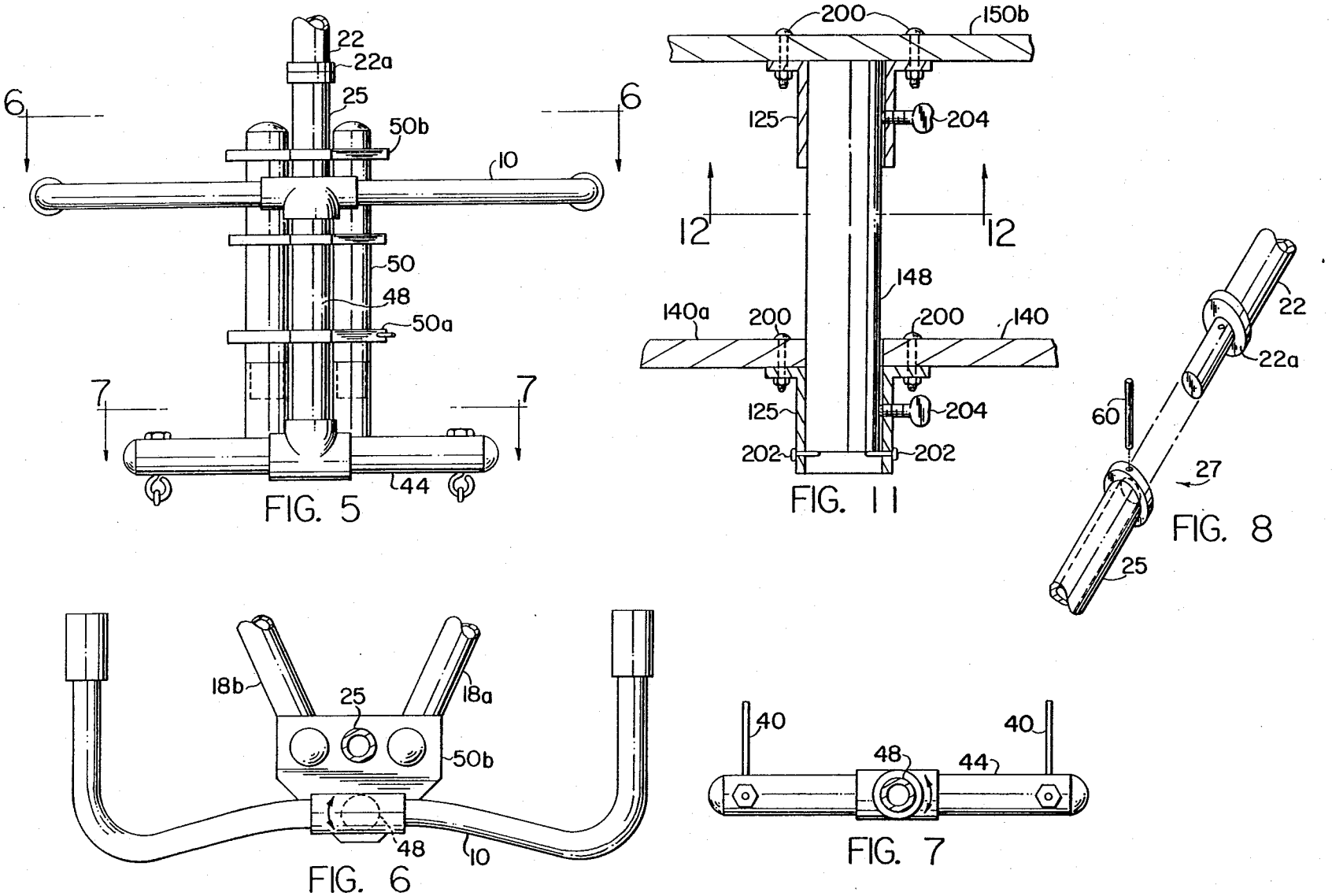
FIG. 5 is a front elevational view taken generally on the line 5—5 of FIG. 2.
FIG. 6 is an elevational view taken generally on the line 6—6 of FIG. 5.
FIG. 7 is a sectional view taken generally on the line 7—7 of FIG. 5.
FIG. 8 is an exploded view of a typical telescopic joint used in the craft of FIGS. 1–7.
FIG. 11 is a detailed elevational view showing the support column at the forward end portion of the frame in the FIG. 9 version.

The lower end of the mast 22 includes a collar 22a and a depending portion adapted to fit inside an upwardly open mast receptacle 25 provided for it in the frame as shown in detail in FIG. 5 and in FIG. 6. As so constructed and arranged the mast and sail structure 20 can be conveniently disassembled and reassembled so that the sailing craft can be conveniently transported to and from a body of water by the owner.

A keel 26 is provided below the platform 18 and it too can be conveniently assembled and disassembled from the frame. The keel 26 includes an upright forward port 28 that is telescopicly received in the lower end of the same tubular member 24 that serves to support the mast at its upper end. The keel 26 further includes an upwardly extending aft post 30 that is similarly supported in a member 32 associated with the aft end portion of the frame.

The aft post 30 associated with the keel 26 further supports two rudder pintles 34, 34 as best shown in FIGS. 1 and 4 and a rudder 36 is pivotably mounted to these pintles 34, 34 by means of pintle portions 38, 38. The rudder 36 is pivotably mounted at the aft end of the keel 26 and its movement is controlled by two cables 40, 40. One end of each cable is secured to the rudder as indicated generally at 42 and the other end of each cable is secured to an appropriate end of the cross bar means 44 best shown in FIGS. 5 and 7. The cross bar means permits the sailor to steer his craft when positioned as shown in FIG. 1, that is, solely by use of his feet.

Turning next to a detailed description of the U-shaped frame that supports the various components of the craft, FIG. 2 illustrates the generally horizontally extending support portion 18 and also shows in broken lines the outline for the floatation means 14. As shown the U-shaped frame includes forward and aft upright end portions, 50 and 52 respectively, that form upright leg portions of the U and the base of the U is defined by the horizontally extending support portion or platform 18. More particularly the support portion 18 includes acurately shaped tubular members **18*a* and 18*b* that are joined at their forward and aft ends to the fore and aft upright end portions 50 and 52. Cross braces 18c and 18d are provided to strengthen the resulting support portion 18 and plastic straps or tape of the type utilized in conventional lawn chairs is provided between these various elements of the support portion 18 to define a suitable seat for the sailor/occupant as suggested in FIG. 1**.

The forward end portion 50 of the frame includes the above-identified vertically oriented tubular mast and keel support post element 25 and vertically spaced generally triangularly shaped plates 50a and 50b serve to support the upwardly turned end portions of the support portion 18a and 18b alongside this tubular element 24 as best shown in FIG. 2 and FIG. 6. Another vertically oriented tubular member 48 is supported in these plates 50a and 50b and serves to define a bearing means for the foot operated cross bar 10 and the rudder connected cross bar 44 as best shown in FIG. 5 and FIG. 6.

The aft end portion of the U-shaped frame is illustrated in FIG. 3. A central vertically extending bearing support tube 32 locates the upwardly extending post 30 of the keel, and also serves to support a backrest or seatback by means of clips 52a and 52b. The seatback 52 defines an open framework for supporting plastic tape or straps as described above, and the lower end portions of the seatback are joined to the aft ends of the platform elements 18a and 18b either by a suitable telescopic joint connection or by providing these elements 18a and 18b in one piece with the seatback itself so that the entire support frame and seatback is of unitary configuration with right angle bends to form the upright aft end portion of the frame. A seatback cross bar 54 is provided to further strengthen the frame aft end portion and connects the horizontally extending support portions 18a and 18b.

As so constructed and arranged the components of the sailing craft can be conveniently assembled and disassembled. As mentioned previously the mast and sail structure can be disconnected by removing a pin 60 from the telescopic joint provided generally in the area of 27 of FIG. 1. FIG. 8 shows this joint in detail. So too, the keel 26 can be disassembled from the U-shaped frame by withdrawing a pin provided in the lower end of the vertically oriented member 25 and in the upright post 28 as well as withdrawing pin 56 associated with the aft end of the rudder and support frame. Tube 48 is integrally connected at its upper and lower ends to the steering bar 10 and cross bar 44 so that the entire unit moves in the journal bearing defined for it by the plates 50a and 50b. The cables 40, 40 can be conveniently disconnected from the rudder at the connections indicated generally at 42 so as to separate the keel and rudder from the support frame. Finally, the support frame and buoyancy means 14 are simply strapped together and these components can be disassembled or reassembled quite readily as well.

DETAILED DESCRIPTION OF FIGS. 9–12

Figure 9:
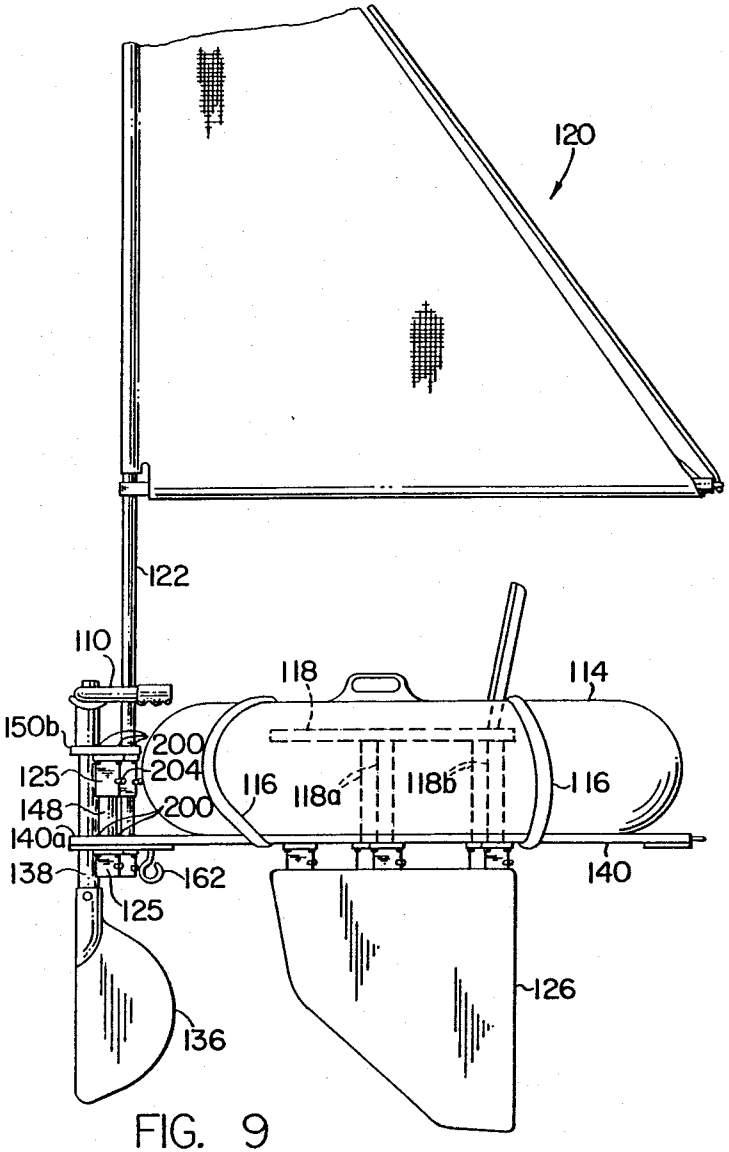
FIG. 9 is a side elevational view illustrating an alternative version of the present invention.

FIG. 9 shows a small sailing craft comprising a generally horizontally extending frame 140 defining a support portion for buoyant cockpit defining means 114. The frame has a forward end portion 140a that includes an upper plate portion 150b mounted to the lower portion 140a by means of vertically extending columns 148, 148.

A keel 126 is mounted to the underside of the horizontally extending support portion 140 by two vertically extended posts 124, 132 provided adjacent the forward and trailing ends respectively of the keel 126.

A rudder 136 is provided on a vertically extending rudder post 138, and the rudder post 138 is pivotably mounted in the forward end portion 140a of the frame 140. The upper plate 150b of the forward end portion serves to provide an additional journal bearing for the rudder post 138 and the rudder post carries at its upper end a cross bar 110 that is used by the sailor's feet to achieve directional control for the craft as described previously with reference to the embodiment of FIGS. 1–8 inclusively.

Buoyant cockpit defining means in the form of an inflatable inner tube or donut shaped float 114 is provided on the horizontal extending platform 140 that is secured thereto by straps 116 as shown in FIG. 9. The opening of the donut shaped float 114 receives a seat 118 that is mounted to the top surface of the support frame 140 on posts as indicated generally at 118a and 118b. These support posts for the seat 118 like the support posts 124 and 132 for the keel 126 permit these components to be readily disassembled from the generally horizontally extending frame support portion 140. The underside of the frame 140 has flanged fittings 125,125 secured thereto for detachably mounting these columns and posts 118a, 118b, 124, 122 and 148, 148.

Figure 12:
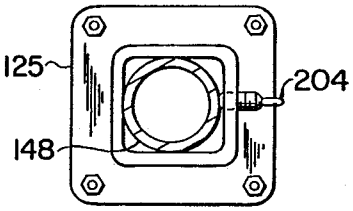
FIG. 12 is a bottom view of FIG. 11.

As shown in FIGS. 11 and 12 these flanged fittings 125, 125 are secured to the board or frame 140 by fasteners 200, 200. Openings are provided in the board or frame to receive the lower end of a tubular member such as the column 148. The flanged fitting also has an opening to receive the member 148 and preferably includes means such as rivets 202, 202 for further supporting the member 148. The upper plate 150b is supported by two such tubular columns, 148, 148 as described above. The mast and sail of the structure 120 is supported by similar fittings, and thumb screws 204 and rivets 202 are provided in these flanged fittings as well.

The mast and sail structure 120 is thus provided in the forward end portion 140a of the support frame 140 and it like the rudder post 138 can also be readily disassembled from the frame portion 140 for convenience in transporting a sailing craft constructed in accordance with the present invention. As so constructed and arranged the sailor can sit on the seat 118 provided for him in the craft of FIG. 9 and place his feet on the cross bar 110, holding the main sheet for the sail structure in his hand, leaving the other hand free to hold his favorite beverage.

Figure 10:
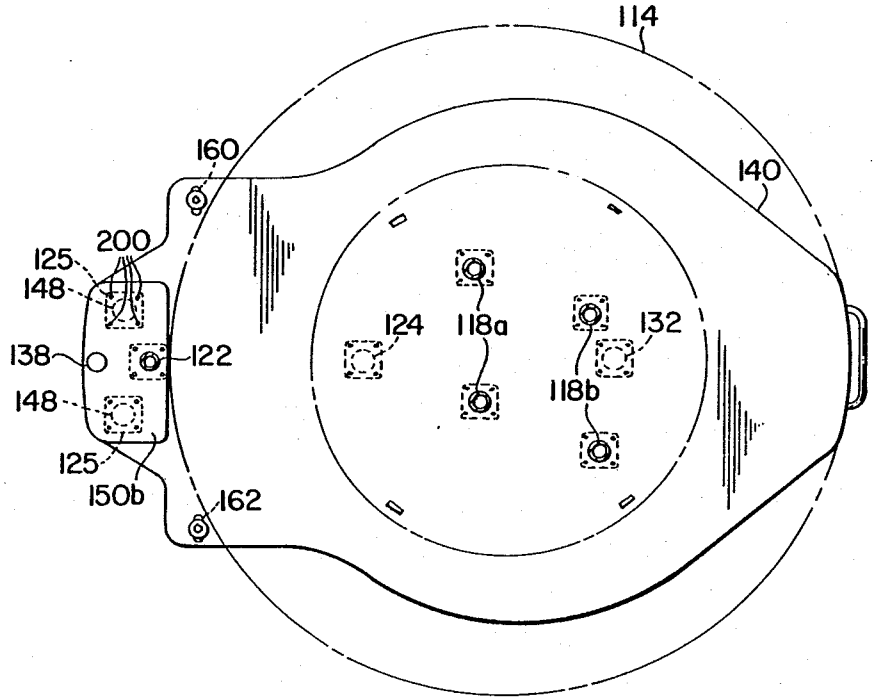
FIG. 10 is a top plan view of the FIG. 9 version with the inflatable means illustrated in broken lines.

The generally flat frame 140 can be quite useful for purposes other than that delineated herein. For example, eyebolts provided at the locations indicated generally at 160 and 162 in FIG. 10 permit the board 140 to be used for a water sled or the like when towed behind another water craft. The upper surface of the board or frame 140 is rendered flat for this purpose simply by disassembling the columns and posts from their flanged fittings, and disassembling the mast structure and rudder as referred to above.

I claim:

1. A small sailing craft comprising a frame with a generally horizontally extending support portion, a keel subadjacent said frame, means for releasably securing said keel to said frame, said frame having a forward end portion, an upright mast and sail structure releasably secured to said forward frame end portion, a rudder movably mounted in said frame, cross bar means pivotably mounted in said frame forward end portion for movement about a generally vertical axis defined by said frame forward end portion, means coupling said cross bar means to said rudder for movement of the rudder in response to pivotal movement of the cross bar means, said means securing said keel to said frame comprising for and aft posts, said posts secured to the underside of said frame support portion, said frame support portion including a raised seat, and buoyant means comprising an inflatable donut shape having an opening to receive said seat for locating said buoyant means on said frame support portion and said cross arm means including foot operable portions adjacent the forward frame end portion whereby the necessity for hand held rudder steering devices is obviated.

2. The combination of claim 1 wherein said means coupling said cross bar means to said rudder comprises a vertically extending tube with an upper end and lower end, said foot engageable portions comprising a bar component mounted to the upper end of said tube, and said rudder mounted to said lower end of said tube.

3. The combination of claim 2 wherein said frame support portion comprises a generally flat board, said seat being movably secured to said board, and said frame forward end portion comprising a removable raised platform defining first and second parallel generally vertical bearing supports for pivotably supporting said mast and said rudder support tube respectively.

4. The combination of claim 3 further comprising restraining means for securing said inflatable donut shape to said frame.

* * * * *